US006468050B2

(12) United States Patent
Hashimoto et al.

(10) Patent No.: US 6,468,050 B2
(45) Date of Patent: Oct. 22, 2002

(54) CYLINDER HEAD ASSEMBLY INCLUDING PARTITIONS DISPOSED IN REFRIGERANT INTRODUCTION PATH AND RECIPROCATING COMPRESSOR USING THE SAME

(75) Inventors: Kenji Hashimoto; Yoshito Matsumura, both of Gunma; Yoshinobu Ichikawa, Maebashi; Taizo Sato, Isesaki, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/774,597

(22) Filed: Feb. 1, 2001

(65) Prior Publication Data

US 2002/0026871 A1 Mar. 7, 2002

(30) Foreign Application Priority Data

Mar. 7, 2000 (JP) ..... 2000-061355

(51) Int. Cl.[7] ..... F04B 1/12
(52) U.S. Cl. ..... 417/269; 417/222.2
(58) Field of Search ..... 417/269, 222.2

(56) References Cited

U.S. PATENT DOCUMENTS 4,693,674 A 9/1987 Fukai et al. ..... 417/269
4,722,671 A 2/1988 Azami et al. ..... 417/269
5,101,555 A 4/1992 Hauser ..... 29/888.02
5,382,139 A * 1/1995 Kawaguchi et al. ..... 417/269
5,556,260 A * 9/1996 Takenaka et al. ..... 417/269
5,674,054 A * 10/1997 Ota et al. ..... 417/269

* cited by examiner

*Primary Examiner*—Timothy S. Thorpe
*Assistant Examiner*—Michael K. Gray
(74) *Attorney, Agent, or Firm*—Baker Botts L.L.P.

(57) ABSTRACT

A reciprocating compressor of a type includes a cylinder block having a plurality of bores disposed in parallel with each other, a valve plate having suction ports corresponding to the respective bores, a cylinder head for closing the outer end of the cylinder block through the valve plate which is held between the cylinder head and the cylinder block and on which suction valves and discharge valves are mounted, a suction chamber formed in the cylinder head adjacent to a refrigerant introduction port, and pistons inserted into the respective bores so as to reciprocate in a predetermined phase difference. In the reciprocating compressor, partitions are disposed in the cylinder head around the outer periphery of the suction chamber for introducing suction gas into the respective bores.

7 Claims, 3 Drawing Sheets

CYLINDER HEAD ASSEMBLY INCLUDING PARTITIONS DISPOSED IN REFRIGERANT INTRODUCTION PATH AND RECIPROCATING COMPRESSOR USING THE SAME

BACKGROUND OF THE INVENTION

1. Field of the Invention

The present invention relates to a compressor preferably applied to automotive air conditioning, and more particularly, to a multi-cylinder reciprocating compressor including single-head-type pistons.

2. Description of the Related Art

Hitherto, reciprocating compressors are used for a refrigerating circuit and the like of automotive air conditioners. A conventional reciprocating compressor includes a cylinder block having a plurality of cylinder bores in which pistons are accommodated and a front housing disposed at an end of a casing. A cylinder head is disposed at the other end of the cylinder block of the casing through a valve plate unit. Further, the compressor includes a rotating shaft inserted into the cylinder block of the casing passing through the front housing, a rotor disposed sequentially from a side near to the front housing of the rotating shaft, a swash plate, and a swing plate. An end of the rotor is rotatably supported by the inner wall of the front housing and the other end thereof is coupled with an end of the swash plate disposed around the rotating shaft through a hinge mechanism. The swing plate is disposed around the cylindrical portion of the swash plate at the center thereof. The swing plate is swingable in an axial direction with respect to the swash plate but the rotation thereof around an axis is prevented. The pistons accommodated in the cylinder bores are connected to the other end of the swing plate in a vicinity of the periphery thereof through piston rods.

Further, the cylinder head includes a first cylinder head unit and disposed outside of the compressor and a second cylinder head interposed between the first cylinder head unit and the valve plate unit. These first and second cylinder head units are fixed by bolts.

The first cylinder head unit includes a bottom wall, a side wall disposed around the bottom wall and a partition disposed inside of the side wall. A refrigerant introducing through hole is formed through the bottom wall at the center thereof. The interior of the first cylinder head unit is widened and forms a suction chamber between it and the outside bottom surface of the second cylinder head unit. Further, a discharge port is formed at a position outwardly of the center of the bottom wall and the periphery of the discharge port is arranged as a boss section formed integrally with the partition. Further, a discharge chamber is formed between the side wall and the valve plate unit.

In the conventional reciprocating compressor, when the rotating shaft is rotated by an external drive source, the rotor is rotated by the rotating shaft and the swash plate coupled with the rotor is rotated thereby. The rotation of the swash plate is converted into the axial reciprocating motions of the pistons in the cylinder bores through the swing motion of the swing plate and through the reciprocating motions of the piston rods.

With this arrangement, refrigerant from an external refrigerant circuit is introduced into a suction room from the refrigerant introduction port through a suction chamber and reaches the cylinder bores from the suction room through suction ports. The refrigerant in the cylinder bores are compressed by the pistons and discharged into the discharge chamber from a discharge outlet. The compressed refrigerant discharged into the discharge chamber is supplied to the external refrigerant circuit through a discharge port.

As described above, the conventional cylinder head has a series of partition for separating the inner space thereof into the suction room and the discharge chamber, and the suction room is arranged as a common suction space with no partition. Therefore, refrigerant gas introduced from the introduction port of the cylinder head is sequentially sucked into the respective bores from the suction port of a valve plate coupled with the cylinder block according to the suction stroke of the pistons.

In the conventional suction gas paths, each of the paths from the refrigerant introduction port of the cylinder head to each of the suction ports of the respective bores has a different length, even if it is disposed on the center axis of the cylinder head, depending on various factors such as the position of the discharge port and the interference by reinforcing members. Moreover, the refrigerant gas is sucked in the common suction space, causing pressure pulsation in the suction gas by the mutual interference of the gas sucked into the respective bores.

The pressure pulsation is transmitted to an evaporator in a compartment through piping, from which a problem arises in that unpleasant noise is generated by resonance.

SUMMARY OF THE INVENTION

It is an object of the present invention to provide a cylinder head assembly capable of preventing noise in a compartment by preventing mutual interference of suction gas and by avoiding suction pulsation caused by pressure change.

It is another object of the present invention to provide a reciprocating compressor including the above cylinder head assembly.

It is still another object of the present invention to provide a cylinder head assembly which can be assembled simply.

It is yet another object of the present invention to provide a reciprocating compressor including the above cylinder head assembly.

According to an aspect of the present invention, there is provided a reciprocating compressor which includes a cylinder block having a plurality of bores disposed in parallel with each other, a valve plate having suction ports corresponding to the respective bores, a cylinder head for closing the outer end of the cylinder block through the valve plate which is held between the cylinder head and the cylinder block and on which suction valves and discharge valves are mounted, and pistons inserted into the respective bores so as to reciprocate in a predetermined phase difference, said cylinder head having a suction chamber formed in the cylinder head adjacent to a refrigerant introduction port, and partitions disposed in the cylinder head around the outer periphery of the suction chamber for introducing suction gas into the respective bores.

According to another aspect of the present invention, there is provided a cylinder head assembly which is disposed at an end of a cylinder block having a plurality of cylinder bores of a compressor for closing the outer end of the cylinder block, and Which includes a cylinder head main body acting as an outer shell, and a partition plate for constituting a discharge chamber. In the aspect of the present invnetion, the cylinder head main body comprises a refrigerant introduction port, a suction chamber disposed adjacent to the refrigerant introduction port, and partitions disposed in the cylinder head around the outer periphery of the discharge chamber for introducing suction gas into the respective bores.

DESCRIPTION OF THE PREFERRED EMBODIMENTS

First, a conventional compressor will be described with reference to FIG. 1 for the easy understanding of the present invention prior to the description of a preferable embodiment of the present invention.

Figure 1:
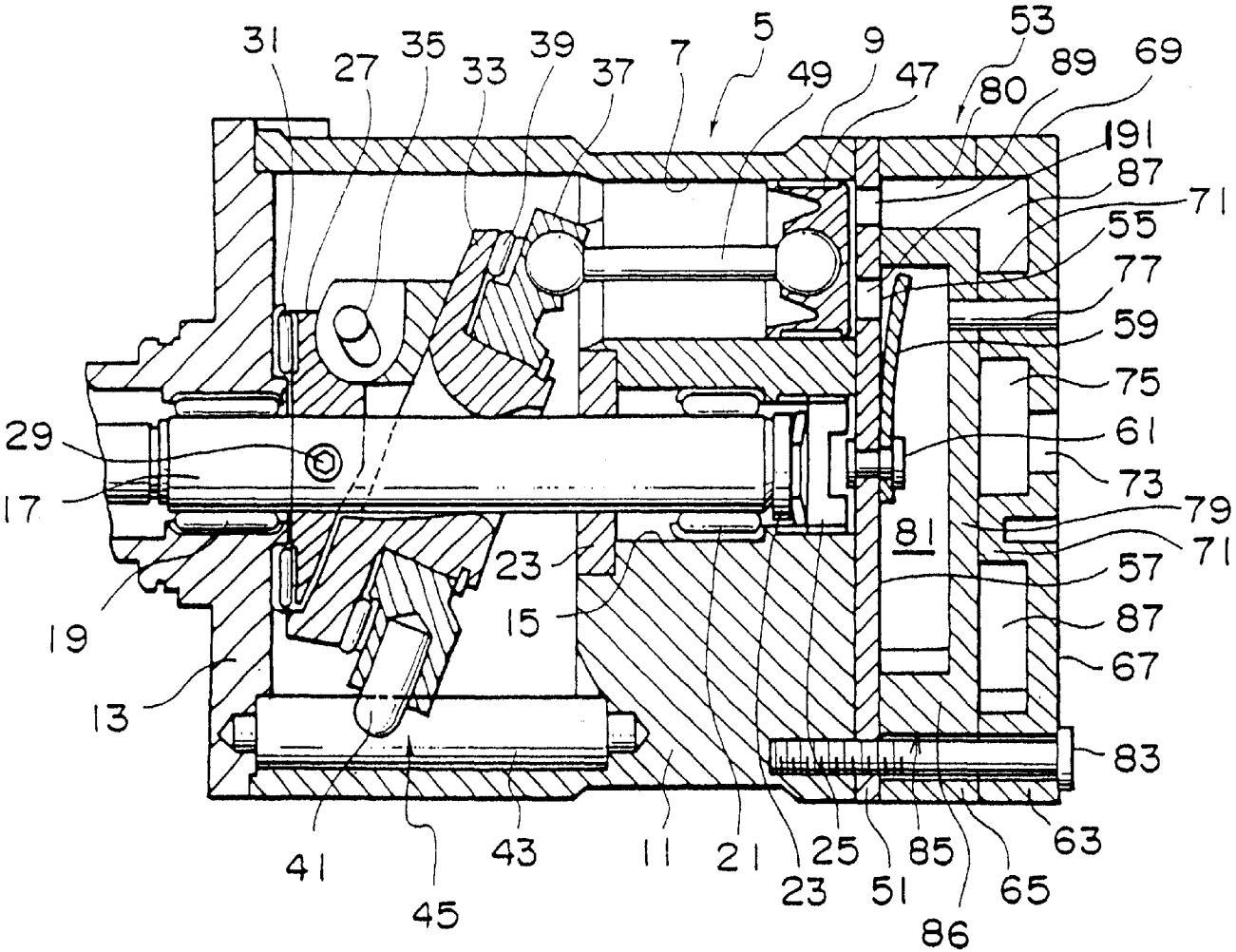
FIG. 1 PRIOR ART
FIG. 1 is a sectional view showing a reciprocating compressor as an example of a conventional compressor.

Referring to FIG. 1, a reciprocating compressor 5 includes a cylinder block 11 formed integrally with a casing 9. The cylinder block 11 includes a plurality of cylinder bores 7. A front housing 13 is disposed at an end of the casing 9. Further, the reciprocating compressor 5 includes a rotating shaft 17 that is inserted into the insert hole 15 of the cylinder block 11 in the casing 9 passing through the front housing 13. The rotating shaft 17 is rotatably supported by the front housing 13 and the cylinder block 11 through bearings 19 and 21. Further, a spring member 23 and a screw adjuster 25 are disposed to restrict thrust movement of the rotating shaft 17. A rotor 27 is disposed to the rotating shaft 17 at a position thereof near to the front housing 13 and is fixed to the rotating shaft 17 by a bolt 29. An end of the rotor 27 is supported by the inner wall of the front housing 13 through a thrust bearing 31. Further, the other end of the rotor 27 is coupled with an end of a swash plate 33 disposed around the rotating shaft 17 through a hinge mechanism 35. A swing plate 37 is disposed around the cylindrical portion of the swash plate 33 at the center thereof. The swing plate 37 is disposed so as to slide and rotate with respect to the swash plate 33 through a thrust bearing 39. A groove is formed in a portion 41 of the swing plate 37, and the groove is fitted to a rail plate 43 disposed in the casing 9 so as to move along an axial direction. A rotation preventing mechanism 45 is composed of the groove and the rail plate 43.

The rotation prevention mechanism 45 permits the swing plate 37 to move in a direction along the rotating shaft 17 but prohibits it to rotate around the rotating shaft 17.

Pistons 47 are disposed in the cylinder bores 7 of the cylinder block 11. The pistons 47 are connected to the periphery of the swing plate 37 at the other end thereof through piston rods 49.

A cylinder head 53 is disposed at the other end of the cylinder block 11 of the casing 9 through a valve plate unit 51.

The valve plate unit 51 includes a valve plate main body 57 and a retainer 59. The valve plate main body 57 has a suction valve (not shown) both the surfaces of which are formed integrally with seal members and a discharge valve 55, and the retainer 59 is disposed so as to cover the discharge valve 55. The retainer 59 is assembled by a bolt 61 so that it is integrated with the valve plate main body 57.

The cylinder head 53 includes a first cylinder head unit 63 disposed outside of the compressor and a second cylinder head 65 interposed between the first cylinder head unit 63 and the valve plate unit 51.

The first cylinder head unit 63 has a bottom wall 67 and a side wall disposed around the bottom wall 67 continuous to it. Further, a partition 71 is disposed internally of a side wall 69. A through hole is formed through the bottom wall 67 at the center thereof and constitutes a refrigerant introduction hole 73 for introducing refrigerant. The interior of the bottom wall 67 is widened from the refrigerant introduction hole 73 and a suction chamber 75 is formed between the bottom wall 67 and the outer bottom surface of the second cylinder head 65. Further, a discharge port 77 is formed through the bottom wall 67 at a position outwardly of the center thereof, and the periphery of the discharge port 77 is arranged as a boss section that is formed integrally with the partition 71.

The second cylinder head unit 65 has a partition 85 composed of a side wall 86 and a bottom wall 79. A suction passage 80 is formed as a through hole provided in the partition 85 and extended from suction room 87 and a suction port 89. A discharge chamber 81 is defined by the side wall 86, the bottom wall 79, and the valve plate unit 51.

The cylinder head 53 is coupled with the cylinder block 11 through bolts 83 screwed into the holes formed in the cylinder block 11. Note that while the partition 85 is formed by the bottom wall 79 and the side wall 86 integrally formed, the bottom wall 79 and the side wall 86 may be partly or entirely formed as separate members.

In the conventional reciprocating compressor arranged as described above, when the rotating shaft 17 is rotated by an external drive source (not shown), the rotor 27 is rotated by the rotating shaft 17 and, the swash plate 33 that is coupled with the rotor 27 is rotated thereby. The rotation of the swash plate 33 is converted into the reciprocating motions of the pistons 47 in the cylinder bores 7 through the swing motion of the swing plate 37 and through the reciprocating motion of the piston rods 49.

With this arrangement, the refrigerant is introduced from the refrigerant introduction hole 73 into a suction room 87 through suction chamber 75, reaches the cylinder bores 7 from the suction room 87 through the suction passage 80 and the suction port 89, is compressed by the pistons 47, discharged into a discharge room 81 through a discharge port 191, and supplied to an external refrigerant circuit through the discharge port 77.

As described above, the conventional cylinder head 53 has the series of the partition for separating the inner space into the suction room 87 and the discharge room 81, and the suction room 87 is arranged as a suction space without any partition. Accordingly, refrigerant gas introduced from the introduction port of the cylinder head is sequentially sucked into the respective bores 7 from the suction port of the valve plate unit 51 coupled with the cylinder block 11 according to the suction stroke of the pistons.

Then, the embodiment of the present invention will be described with reference to FIGS. 2, 3A, and 3B.

Figure 2:
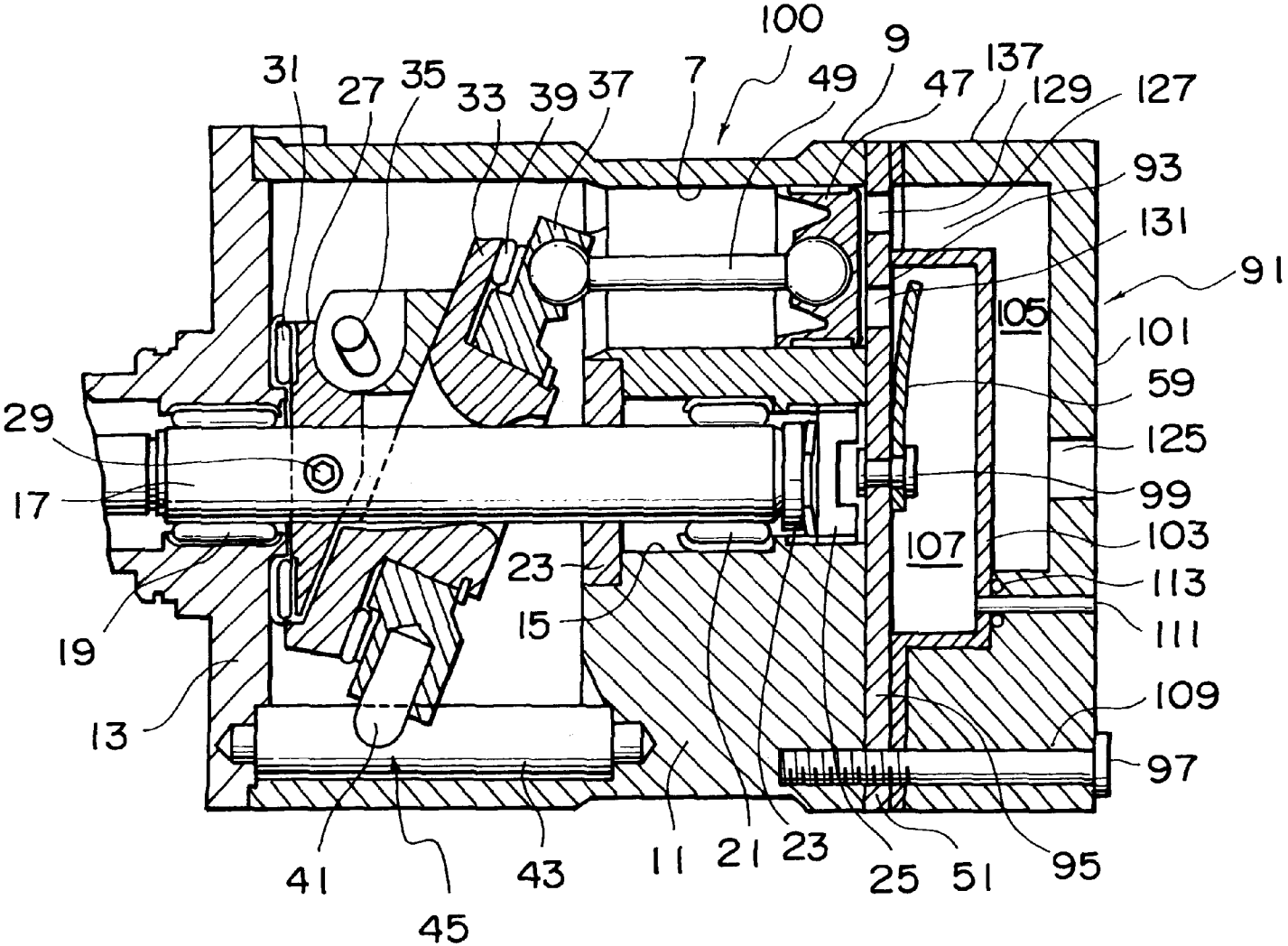
FIG. 2 is a sectional view showing a reciprocating compressor according to an embodiment of the present invention.

Referring to FIG. 2, a reciprocating compressor 100 according to the embodiment of the present invention includes a cylinder block 11 having a plurality of cylinder bores 7 and formed integrally with a casing 9 and a front housing 13 disposed at an end of the casing 9. Further, the reciprocating compressor 100 includes a rotating shaft 17 that is inserted into a insert hole 15 of the cylinder block 11 in the casing 9 passing through the front housing 13. The rotating shaft 17 is rotatably supported by the front housing 13 and the cylinder block 11 through bearings 19 and 21 as well as restricted in an axial direction by a spring member 23 and a screw adjuster 25. A rotor 27 is disposed to the rotating shaft 17 at a position thereof near to the front housing 13 and is fixed to the rotating shaft 17 by a bolt 29. An end of the rotor 27 is supported by the inner wall of the front housing 13 through a thrust bearing 31, and the other end thereof is coupled with an end of a swash plate 33 disposed around the rotating shaft 17 through a hinge mechanism 35. A swing plate 37 is disposed around the cylindrical portion of the swash plate 33 at the center thereof so as to slide and rotate with respect to the swash plate 33 through a thrust bearing 39. A groove is formed in a portion 41 of the periphery of the swing plate 37, the groove is fitted to a rail plate 43 disposed in the casing 9 so as to move along an axial direction, and constitutes a rotation preventing mechanism 45 together with the rail plate 43. The rotation prevention mechanism 45 permits the swing plate 37 to move in a direction along the rotating shaft 17 but prohibits it to rotate therearound.

Pistons 47 are disposed in the cylinder bores 7 of the cylinder block 11 and connected to the periphery of the other end of the swing plate 37 through piston rods 49.

A cylinder head 91 is disposed at the other end of the cylinder block 11 of the casing 9 through a valve plate unit 51.

The valve plate unit 51 includes a valve plate main body 95 and retainers 59. The valve plate main body 95 has suction valves (not shown) both the surfaces of which are formed integrally with seal members and discharge valves 93, and the retainers 59 are disposed so as to cover the discharge valves 93. They are assembled by a bolt 99 so that they are integrated with the valve plate main body 95.

The above arrangement of the reciprocating compressor 100 is substantially the same as that of the conventional reciprocating compressor 5 excepting a cylinder head.

The cylinder head 91 according to the embodiment of the present invention includes a cylinder head main body 101 disposed outside of the reciprocating compressor 100 and a partition plate 103 interposed between the cylinder head main body 101 and the valve plate unit 51.

The cylinder head main body 101 is composed of a diecast aluminum and formed in a cup shape having a bottom wall and a side wall. A refrigerant introduction port 125 is formed through the bottom wall at the center thereof.

Further, the partition plate 103 is interposed between the cylinder head main body 101 and the valve plate unit 51 and is composed of a reduced steel plate. A suction chamber 105 is formed between the partition plate 103 and the cylinder head main body 101, whereas a discharge chamber 107 is formed between the partition plate 103 and the valve plate unit 51. The suction chamber 105 is disposed downstream of the refrigerant introduction port 125 in communication therewith. A discharge port 111 is formed so as to pass through the partitions 109 of the cylinder head main body 101 from the discharge chamber 107 and to reach the outside. A seal member 113 is disposed to the portion where the discharge port 111 is connected to the partition plate 103 and the partitions 109 of the cylinder head 91.

Figure 3A:
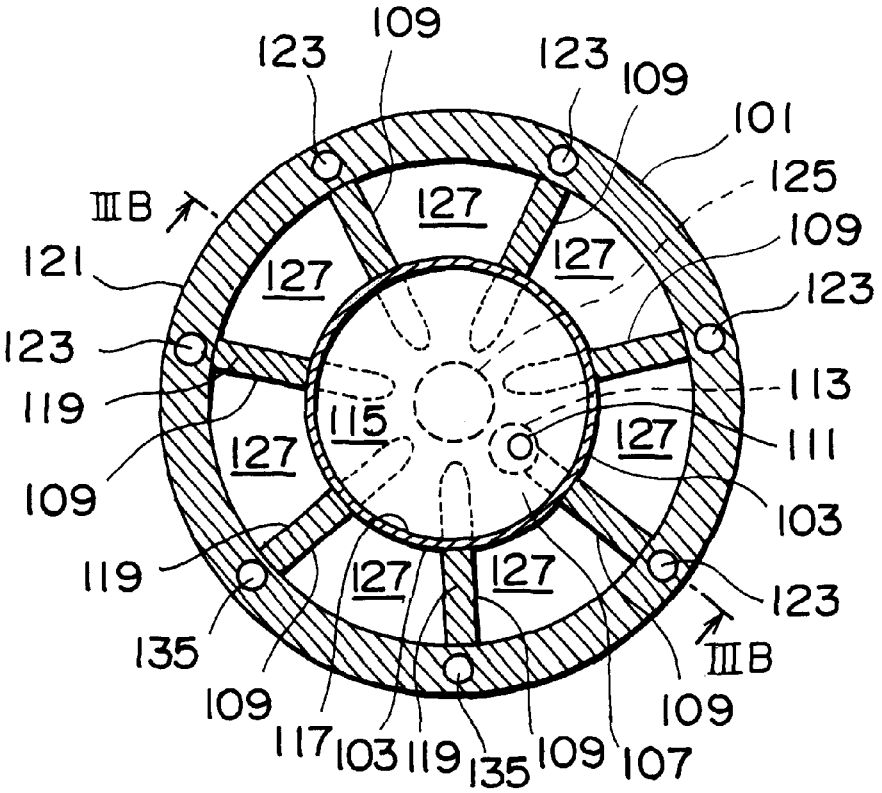
FIG. 3A is a view showing a cylinder head of the reciprocating compressor of FIG. 2 when it is viewed from the side of a valve plate unit.
Figure 3B:
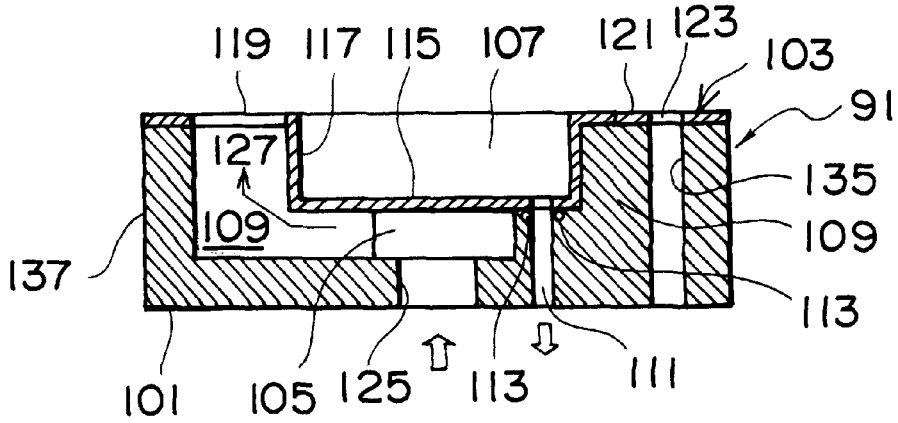
FIG. 3B is a sectional view taken along the line IIIB—IIIB of the cylinder head of FIG. 3A.

As shown in FIGS. 3A and 3B, the partition plate 103 is formed by reducing a steel plate and includes a central bottom portion 115, a side portion 117 formed from the bottom portion 115 along the periphery thereof, partition abutting portions 119 extending radially outwardly from the upper end of the side portion 117 and a ring-shaped outer peripheral portion 121 for connecting the outer ends of the partition abutting portions 119.

The discharge port 111 is formed through the bottom portion 115 of the partition plate 103 and further screw holes 123 are formed through the outer periphery of the partition plate 103 for fixing it by screws in cooperative to throgh-holes 135 provided into the cylinder head main body 101.

The partitions 109 are formed to the cylinder head main body 101 radially outwardly from a vicinity of a refrigerant introduction port 125. The partition abutting portions 119 of the partition plate 103 are arranged so as to come into contact with the upper apex surface of the partitions 109. A suction space is divided by the partitions 109, and the respective divided suction spaces are disposed in correspondence to the respective cylinder bores 7 and form suction paths 127, respectively.

In the reciprocating compressor according to the embodiment of the present invention arranged as described above, when the rotating shaft 17 is rotated by an external drive source (not shown), the rotor 27 is rotated by the rotating shaft 17 and the swash plate 33 coupled with the rotor 27 is rotated thereby. The rotation of the swash plate 33 is converted into the axial reciprocating motions of the pistons 47 in the cylinder bores 7 through the swing motion of the swing plate 37 and the reciprocating motion of the piston rods 49.

As a result, refrigerant is introduced into the suction chamber 105 from the refrigerant introduction port 125, reaches the cylinder bores 7 from the suction chamber 105 through the respective suction paths 127 and suction ports 129, is compressed by the pistons 47, discharged into the discharge chamber 107 from discharged ports 131, and supplied to an external refrigerant circuit (not shown) through the discharge port 111.

After suction gas is introduced into the suction chamber 105, it is introduced into the suction paths 127, which are independent suction paths partitioned by the partitions 109 in correspondence to the respective cylinder bores 7, and then introduced into the cylinder bores 7. As a result, the mutual interference of the suction gas is prevented and pressure pulsation is attenuated.

As described above, according to the cylinder head 91 of the embodiment of the present invention, after the suction gas is introduced into the suction chamber 105, it is introduced into the suction paths, from which it is sucked into the respective cylinder bores 7 through the partitions 109. As a result, the mutual interference of the suction gas is prevented and further the pressure losses from the refrigerant introduction port 125 to the respective bores and the distances of the flow paths therebetween are equalized, which can attenuate the pressure pulsation.

In the embodiment of the present invention described above, the reciprocating compressor has the piston rods 49 one ends of which are connected to the swing plate 37 at the positions near to the outer periphery of the one surface thereof and the other ends of which are coupled with the pistons 47. However, it is apparent that the present invention can be applied to a type of compressor which converts the motion of a rotating swash plate into the reciprocating motions of pistons through a shoe.

Accordingly, in the present invention, since the suction gas paths through which the suction gas is sucked into the respective cylinder bores 7 are arranged as the independent paths by the partition, the mutual interference of the suction gas can be prevented and the pulsation of the suction gas caused by pressure change can be avoided. As a result, the reciprocating compressor 100 capable of preventing noise in a compartment can be provided.

Further, according to the present invention, the cylinder head main body 101 is arranged independently of the partition plate, which makes it possible to provide the reciprocating compressor in which the complex refrigerant paths can be simply arranged and in which the cylinder head can be simply assembled.

What is claimed is:

1. A reciprocating compressor comprising:

a cylinder block having a plurality of bores disposed in parallel with each other;

a valve plate having suction ports corresponding to said respective bores;

a cylinder head for closing the outer end of said cylinder block, wherein said valve plate is held between said cylinder head and said cylinder block and suction valves and discharge valves are mounted on said valve plate; and pistons inserted into said respective bores so as to reciprocate in a predetermined phase difference, wherein said cylinder head comprises a suction chamber formed in said cylinder head adjacent to a refrigerant introduction port and partitions are disposed in said cylinder head around the outer periphery of said suction chamber for introducing suction gas into said respective bores, wherein said partitions extend radially outward from a fluid introduction port to form a plurality of refrigerant paths adapted to be in fluid communication with said respective bores.

2. A reciprocating compressor according to claim 1, wherein said cylinder head further comprises a discharge chamber partitioned from said suction chamber.

3. A reciprocating compressor according to claim 2, wherein said discharge chamber is formed by said valve plate and a reduced steel plate having a cup-shape.

4. A cylinder head assembly disposed at an end of a cylinder block having a plurality of cylinder bores of a compressor for closing the outer end of said cylinder block, said cylinder head assembly comprising:

a cylinder head main body acting as an outer shall, wherein said cylinder head main body comprises:

a refrigerant introduction port;

a suction chamber disposed adjacent to said refrigerant introduction port; and a plurality of partitions disposed in said cylinder head around the outer periphery of said suction chamber, wherein said partitions extend radially outward from a fluid introduction port to form a plurality of refrigerant paths adapted to be in fluid communication with said respective bores.

5. A cylinder head assembly according to claim 4, wherein said cylinder head further comprises a discharge chamber partitioned from said suction chamber.

6. A cylinder head assembly according to claim 5, wherein said partition plate is composed of a reduced steel plate formed in a cup-shape.

7. A cylinder head assembly according to claim 5, wherein said cylinder head main body is composed of a diecast aluminum.

* * * * *